US007353868B2

(12) United States Patent
Golby et al.

(10) Patent No.: US 7,353,868 B2
(45) Date of Patent: Apr. 8, 2008

(54) WIRELINE COUPLER

(75) Inventors: Brian Golby, Calgary (CA); Brad Gabel, Calgary (CA)

(73) Assignee: 789047 Alberta Ltd., Calgary, Alberta (CA)

( * ) Notice: Subject to any disclaimer, the term of this patent is extended or adjusted under 35 U.S.C. 154(b) by 216 days.

(21) Appl. No.: 10/998,536

(22) Filed: Nov. 30, 2004

(65) Prior Publication Data

US 2005/0183860 A1 Aug. 25, 2005

(30) Foreign Application Priority Data

Feb. 24, 2004 (CA) ..... 2458580

(51) Int. Cl.
*E21B 17/02* (2006.01)

(52) U.S. Cl. ..... 166/242.6; 285/123.15; 285/123.3

(58) Field of Classification Search ..... 166/242.6; 285/123.15, 123.3; 403/34, 180, 184, 286
See application file for complete search history.

(56) References Cited

U.S. PATENT DOCUMENTS 3,335,799 A * 8/1967 Miller ..... 166/87.1
3,966,236 A * 6/1976 Vann ..... 285/39
3,990,510 A 11/1976 Decuir
4,066,282 A * 1/1978 Vann ..... 285/39
4,375,834 A 3/1983 Trott
4,427,064 A 1/1984 Bowyer
4,542,788 A 9/1985 Semar
4,600,059 A 7/1986 Eggleston et al.
4,726,610 A * 2/1988 George et al. ..... 285/39
4,765,409 A 8/1988 McClure et al.
4,828,291 A * 5/1989 Mitchell et al. ..... 285/39
5,095,993 A 3/1992 Huber et al.
5,423,382 A 6/1995 Barton et al.
6,223,818 B1 5/2001 Hrupp
6,464,013 B2 10/2002 Bystedt
6,520,255 B2 * 2/2003 Tolman et al. ..... 166/281

FOREIGN PATENT DOCUMENTS

CA 1181679 A 1/1985
CA 2119504 A1 5/1995
CA 2227534 A1 1/1998

* cited by examiner

*Primary Examiner*—William Neuder
*Assistant Examiner*—Nicole Coy
(74) *Attorney, Agent, or Firm*—Blake, Cassels & Graydon, LLP

(57) ABSTRACT

A wireline coupler, for use in oil wells and gas wells to connect a perforating gun to the wireline from which the perforating gun is suspended, is designed to eliminate jamming of the wireline between the casing and the perforating gun when the perforating gun is propelled upward by the gases from the explosion of the perforating gun or by the natural gas, oil, or other fluids released through the new perforations.

7 Claims, 4 Drawing Sheets

WIRELINE COUPLER

FIELD OF THE INVENTION

The invention relates to a coupler to connect a wireline to a perforating gun for use in a well hole, the coupler being designed to prevent the perforating gun from bypassing the wireline, and to prevent the wireline from being jammed or damaged, when the perforating gun is propelled uphole by pressures arising upon discharge of the perforating gun or by any bottom hole pressures.

BACKGROUND TO THE INVENTION

The oilfield industry extracts petroleum oil and natural gas from wells drilled into the earth. In conventional oil and natural gas wells, a bore hole is drilled to the desired depth and the bore hole is lined with a casing that is essentially a round pipe installed in the bore hole for substantially the entire depth of the well. Sometimes the pipe is of the type usually called tubing but is used for the purpose of casing. The casing comprises many sections of pipe joined end to end, typically by threaded collars mating with threads on the sections of pipe, until the pipe reaches the desired depth, which is generally thousands of feet into the ground. The diameter of the casing depends on the drill bit used to drill the well, but is smaller than the diameter of the borehole. The outside diameter of the casing is typically 4½ to 20 inches, and the inside diameter is typically ½ inch less than the outside diameter. The casing is usually held in place in the bore hole by material, typically cement, injected between the casing and the side of the bore hole, and when this material solidifies the casing is said to be cemented in place.

In most cases, another pipe substantially smaller than the casing is inserted inside the casing, and held in a position approximately coaxial with the casing by devices of various types, which may be known as packers or as tubing hangers. This inner pipe is called production tubing, and is typically about 2 to 4 inches in outside diameter.

After the casing has been installed, completion of the well requires that the casing be perforated in the production region. The perforations allow oil and natural gas to move from the surrounding earth through the casing. The perforations penetrate both the casing and surrounding cement, and generally reach at least some small distance into the surrounding earth. It will be understood in the oilfield industry that the "earth" is usually rock but the term includes any solid material through which the well has been drilled. When the production tubing is in place, the oil and natural gas will flow continuously through the perforations and into the production tubing, which will have been manufactured with apertures to allow the inflow of oil and natural gas. The oil and natural gas will rise to the top of the production tubing, either by natural pressure on it arising in the earth near the bottom of the well, or by extractive technology such as pumping which is well known in the oilfield industry.

The usual method of perforating the casing uses multiple explosive charges fired simultaneously and configured to direct their explosive forces towards the casing. The device that carries the explosive charges is generally known as a perforating gun, or casing gun. In some types of wells not relevant to the present invention, the perforating gun may be attached to the production tubing for insertion into the well. In the methods of well construction relevant to the present invention, the perforating gun is lowered inside the casing on a wireline. A typical perforating gun is 3⅜ inches in diameter when intended for use in a casing that is 4 inches in inside diameter or larger. Perforating guns come in various lengths, generally between 3 feet and 22 feet, and a number of them may be joined according to the length of casing to be perforated.

Along with the perforating gun, the wireline may support other tools or devices intended for use in oil wells or natural gas wells, referred to here as "oilwell devices". A common oilwell device is a device for determining the depth into the well reached by the perforating gun, so that the perforations will be made in the desired region of the casing where oil or natural gas is expected in the surrounding earth. One commonly used device for determining depth is a collar locator, which detects the magnetic effect of passing the collars that exist where each section of the casing joins another section. By counting the number of casing sections that have passed, each section being of known length, the depth of the collar locator in the well can be calculated. Alternatively, the depth reached by the perforating gun can be determined by observing the length of wireline that has been paid out as the perforating gun was lowered into the well hole. When the perforating gun is in the desired position in terms of depth downhole and orientation in the hole, the explosive elements are triggered to explode. A triggering electrical signal is often sent by an electrical conductor that forms part of the wireline or is associated with the wireline. In other cases, the perforating gun may be triggered mechanically, or by a sensor onboard the perforating gun.

It will be understood in the oilfield industry that "downhole" refers to the direction of the hole away from the point of origin of the drilling, whether the hole is vertical, slanted, curved, horizontal, or oriented in any manner. Similarly, "uphole" refers to the direction towards the point of origin of the drilling as seen from a position in the well.

In principle, the wireline could be attached directly to the perforating gun, with or without a collar locator, but generally the most uphole component in any perforating event, to which the wireline is attached, is an oilwell device with a fishing neck. A fishing neck, familiar in the wireline industry, is adapted to be seized by a grappling device from uphole if the fishing neck and whatever is attached to it have become stuck in the well, so that they can be extracted from the well. The present invention incorporates a fishing neck.

The explosive gas produced in the explosions of the perforating gun tends to lift both the perforating gun and the wireline to which it is attached, along with the fishing neck and any oilwell devices. The newly created perforations also allow an inrush of liberated oil or natural gas or both. In some cases, usually undesirably, the inrushing fluid is water. If the flow and pressure of the inrushing fluid are high, the inrushing fluid contributes to the lifting of the perforating gun and the wireline. For convenient exposition here, the term "pressurized fluid" will be used to denote any or all of gas from an explosion, natural gas, oil, water, and all gaseous or liquid substances that occur inside the casing in the region of the well at or downhole from the perforating gun, and that exert pressure uphole. Of course, the fluid pressure is exerted in all directions, but uphole is generally the only direction in which anything can move a significant distance.

A problem that arises from the lifting by the pressurized fluid of the perforating gun, along with the fishing neck and any collar locator or other oilwell device, is that the wireline goes slack and may become fouled or tangled. When the perforating gun is propelled uphole, it may overtake the wireline and force its way past the wireline and therefore jam or snag the wireline between the casing and any or all of the perforating gun, a fishing neck, a collar locator, and any other oilwell device. In many of such instances, the perforating gun and any oilwell device become jammed within the casing, and the wireline also becomes jammed within the casing, so that the well hole is obstructed. Then it is necessary to fish those obstructing objects out of the well hole, an operation of considerable difficulty and cost.

In prior art, attempts to prevent the perforating gun or other tool from being propelled uphole have used means for gripping the casing. Bowyer's U.S. Pat. No. 4,427,064 discloses a serrated surface that is radially expanded outward in response to upward movement. Hrupp's published Canadian Patent Application No. 2,227,354 discloses an device in which brake plugs are displaced radially outward by movement of a tapered piston that is driven by the explosive force. Such devices are more complex and more expensive that the present invention, and because they are highly mechanical they involve a risk of mechanical failure that is not possible with the present invention.

In order to obtain the most productive wells, high explosive pressure is desired in the perforating gun. With higher pressure, more or larger perforations can be obtained, and the holes punched into the rock can be deeper. With higher pressure, the edges of the perforations are cleaner and debris from the casing and rock tends to be cleared from the holes by being blown back into the casing, thereby eliminating a potential obstruction to the release of oil and natural gas. On the other hand, the higher the pressure, the greater the risk that the perforating gun and any oilwell device will be propelled uphole a considerable distance, so as to tangle the wireline and jam the assembly in the hole. Persons skilled in the art of wireline-controlled perforation attempt to find the ideal explosive charge to maximize perforations without excessive risk of propelling the perforating gun so far or so fast as to cause damage to the wireline and the equipment. The present invention allows larger explosions so that perforating will be more effective while the risk of jamming and a need for fishing will be less likely than with large explosions using the prior art. The larger explosions are especially useful when there is little or no fluid in the well before the perforating action, a circumstance known in the oilfield industry as underbalanced perforating.

SUMMARY OF THE INVENTION

The present invention provides a coupler for use between a wireline and a perforating gun with optional oilwell devices. A typical oilwell device is a collar locator. Another typical oilwell device is a "sub", which is a term in the oilfield industry referring to an adapter, usually threaded, used to connect two pieces of equipment when their respective screw threads or other connectors would not match directly. The coupler may be connected directly to the perforating gun, or connected indirectly to it through one or more oilwell devices. The coupler plus the perforating gun and all oilwell devices will be referred to as the "entire assembly". The coupler prevents the perforating gun and any oilwell devices from bypassing the wireline, and prevents the wireline from being jammed or damaged, when the perforating gun is propelled uphole by pressurized fluid.

The coupler of the present invention comprises:

(a) a cylindrical body having means for connecting to a wireline that will be uphole, and having means for connecting directly or indirectly to a perforating gun that will be downhole, (b) a bypass belt that is an annular portion of said cylindrical body coaxial with said cylinder body, having an outer diameter that is larger than the diameter of the remainder of said cylindrical body, in which the difference between said outer diameter and the inside diameter of the casing of the well hole is less than the diameter of said wireline, (c) said bypass belt containing channels through which gas and liquid may flow from the downhole side of the coupler to the uphole side of the coupler.

The coupler has a generally cylindrical body that in use will have its axis parallel with the axis of the casing. Typically, but not necessarily, the uphole end of the body has a configuration known in the wireline industry as a fishing neck. The body has means for connecting to a wireline that will be uphole, and means for connecting to any oilwell device that will be downhole, one of which will be a perforating gun. Connections to the wireline and to any oilwell device are made above ground before everything thus connected is lowered by the wireline down the well. The coupler has a portion, called the "bypass belt", with an outer diameter larger than the diameter of the remainder of the body of the coupler. That outer diameter of the bypass belt is chosen to be only slightly smaller than the inside diameter of the casing so that the wireline is unable to come between the casing and the coupler in the region of the bypass belt. The bypass belt is provided with longitudinal passages to allow the pressurized fluid to flow from the downhole side to the uphole side of the coupler, with the effect that pressure is dissipated and the coupler is not propelled uphole very far, if any distance.

A fishing neck necessarily has a somewhat streamlined shape facing uphole, to facilitate the operation of a grappling device that seizes it when fishing is needed. In the prior art, that shape unfortunately facilitated the bypassing of a slack portion of a wireline, as happens when the fishing neck along with the perforating gun was propelled uphole. The present invention allows the uphole portion of the fishing neck to retain the shape adapted for the grappling device, and introduces a portion that is not streamlined and that cannot be bypassed by the wireline.

The perforating gun is noticeably smaller in diameter than the casing. For example, a casing having an inside diameter of 4 inches is typically the minimum size recommended for a 3⅜ inches perforating gun. There are at least two reasons for such differences in diameters. First, a close-fitting gun would be difficult to lower into the well. Second, the open space left in that sort of loose fit, as would be seen in a cross section of the well passing through the perforating gun, is necessary to allow the gases from the explosion to escape past the perforating gun. Just before the explosive discharge, the perforating gun is sometimes moved into contact with one side of the casing such that the primary direction of the explosive discharge is toward the area of contact. That positioning serves to enhance the perforating effect of the shaped charge explosives. Such positioning is less important if the perforating gun is the type that fires projectiles to make the perforations. Various means are well known in the oilfield industry for positioning the perforating gun against the casing, some of which means may be incorporated into the perforating gun and others of which may be oilwell devices. Whether the perforating gun is off-centre or centred in the casing, there will be space between the perforating gun and the casing that allows the pressurized fluid to bypass the perforating gun.

The risk that the perforating gun will bypass the wireline arises because some time is required for the pressure to dissipate from downhole of the perforating gun, and during that time the pressure is exerting uphole force on the perforating gun thereby causing the entire assembly to move. The result of that movement is that the wireline goes slack and slumps onto the top of the moving entire assembly, so that the wireline is likely to get into the space between the entire assembly and the casing if not blocked from getting into that space.

The present invention incorporates the bypass belt that is close-fitting to the casing. In the context of the preferred embodiment of the present invention, "close fitting" means that there is insufficient space for the wireline to get between the bypass belt and the casing, but the fit is loose enough to allow the coupler to slide downhole easily and without binding when lowered by the wireline. The present invention can be manufactured to accommodate the size of wireline with which it is intended to be used. For example, if wireline of 5/16-inch diameter is used in a 4-inches inside diameter casing, the bypass belt should preferably be at least 3¾ inches in diameter. The close-fitting feature of the preferred embodiment of the present invention means that it is impossible for the coupler to overtake the wireline and jam the slack part of the wireline between the coupler and the casing. The coupler as a whole, especially the bypass belt of the coupler, carries or pushes the wireline ahead of it as the entire assembly moves uphole. Since the wireline cannot get past the coupler, it also cannot get into the space between the casing and the perforating gun or any oilwell device.

The present invention also decreases the uphole travel of the entire assembly by allowing the explosive gas to bypass it, so that the gas pressure uphole grows and begins to counteract the gas pressure downhole, since the pressure difference is what moves the entire assembly.

The present invention further slows the uphole movement of the entire assembly, and decreases its uphole travel, by dragging on the casing, as a result of being close fitting. The perforating gun alone would not in general be as close fitting and would not experience as much friction against the casing.

The present invention adds mass to the entire assembly. For a given explosive propulsion, the larger the mass, the slower and less far the displacement. By Newton's Second Law, force=mass×acceleration ($F=m*a$), and a consequent equation is $F*t=m*v$, where t is the duration of the force and v is the resulting velocity. In the case of sudden pressure in a well hole, the force is essentially uncontrollable apart from the choice of explosives, but the present invention ensures that the force will decline quickly as pressure dissipates so that time t is short and $F*t$ on the left of the equation is not large. As m is larger, the velocity v is smaller. To illustrate by analogy, a small amount of exploding gunpowder will move a rifle bullet a long way, but will not move a massive cannonball very far. The typical embodiment of the present invention does not increase the mass in a ratio as large as a cannonball to a bullet, but it does make a minor contribution to reducing wireline jamming. For example, a 3⅜ inches diameter perforating gun in a 10-foot length, as sold by Innicor Perforating Systems, Calgary, Alberta, weighs about 215 pounds, so the weight of the coupler in the embodiment described here, which would be about 15 pounds, does not give a large percentage increase but it does make some contribution to mass and inertia. In other embodiments, a larger mass could give a greater effect of reducing uphole travel.

The addition of mass by using the typical embodiment of the present invention slows the uphole movement of the entire assembly in the usual case where the direction of gravity towards the centre of the Earth is substantially aligned with the downhole direction. Gravity decelerates the entire assembly, and the larger the mass the greater the gravitational force opposing the uphole force. When a body moving at a small velocity experiences a decelerating force, such as gravity, it does not move far.

When various decelerating forces (drag, gas pressure on the uphole side, and gravity) are applied to a small initial velocity, the result is that the distance travelled is small. The reduction in distance travelled is one reason why the present invention reduces risk of damage to the wireline, because there is less slack wireline to be bypassed by the perforating gun or any oilwell devices.

The typical embodiment of the present invention reduces risk to the wireline in four ways. First, it fits closely into the casing so that the wireline cannot be jammed between the coupler and the casing and the wireline cannot get downhole of the coupler to be jammed between the perforating gun and the casing. Second, because the coupler is close fitting to the casing, its contact with the casing adds drag that reduces the uphole travel of the entire assembly. Third, the coupler increases the mass that must be moved, and therefore decreases the velocity that a given impulsive force can impart to it and hence decreases the resulting travel. Fourth, by increasing the mass that must be moved, the coupler enhances gravitational deceleration in the usual case where the downhole direction is substantially parallel to gravity, so the entire assembly stops moving sooner and the distance travelled is less.

In order for these benefits to be obtained, the coupler must allow the pressurized fluid to escape at a rate at least as fast as the pressurized fluid escapes from downhole of the perforating gun, or else the coupler and casing would be like a bullet in a barrel. With or without the use of the present invention, the perforating gun is like a loose-fitting bullet. If the perforating gun were like a tight-fitting bullet, it would be very difficult for anything to prevent its being propelled uphole. The typical embodiment of the present invention works because it is like a loose-fitting bullet in terms of its ability to allow pressurized fluid to bypass it, but a moderately tight-fitting bullet in terms of its ability to block the wireline from getting between it and the casing. The added mass also contributes to the success of the present invention.

BRIEF DESCRIPTION OF THE DRAWINGS

The preferred embodiments of the invention will now be described in detail with reference to the following drawings in which.

DETAILED DESCRIPTION OF THE PREFERRED EMBODIMENT

Figure 1:
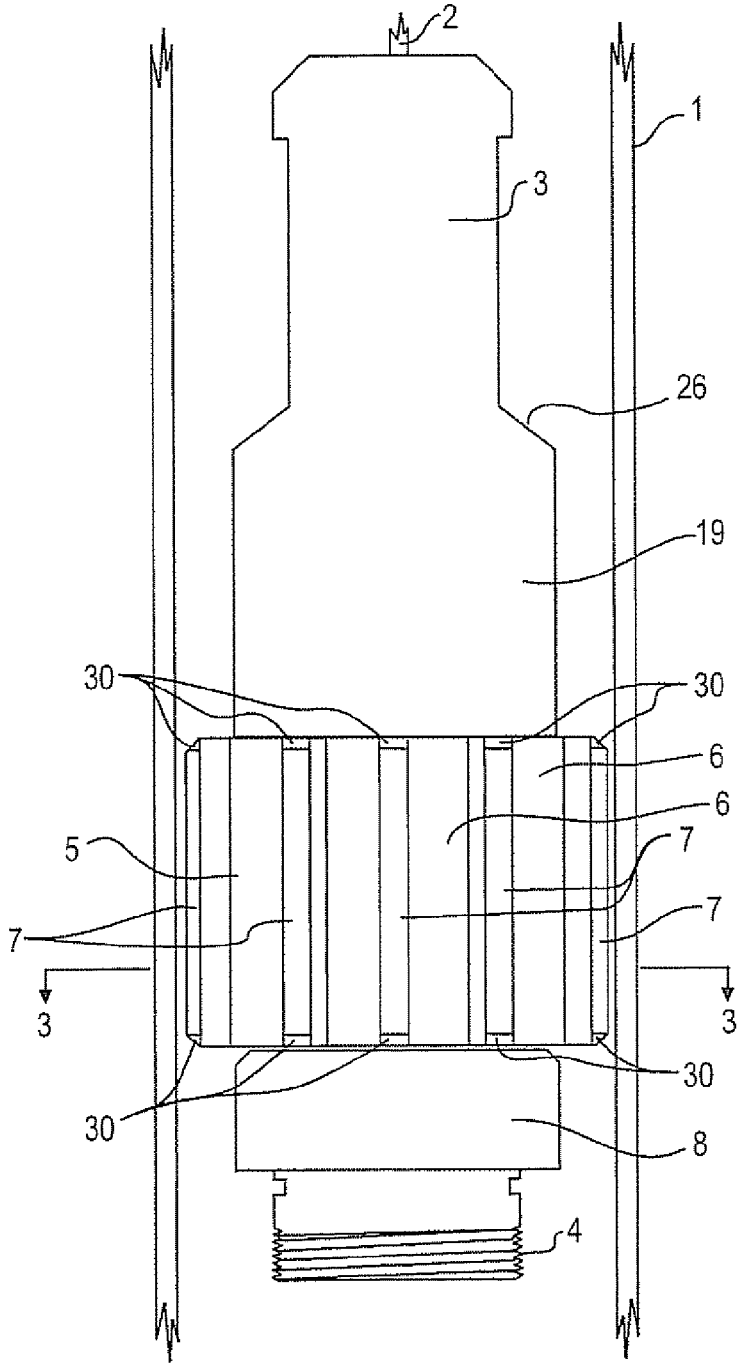
FIG. 1 is an elevation view of one of the preferred embodiments of this invention.

FIG. 1 shows an elevation view of the coupler within a portion of the casing 1. The coupler is suspended from a wireline 2, by means described below. The wireline 2 may be a single strand line, called slick line, or a braided line that may include conductors. As an example a slick line of 0.125 inch diameter is often used in the industry. The coupler for most of its length is of substantially smaller diameter than the casing 1. The upper portion of the coupler is a fishing neck 3, which means that it is adapted to be grabbed by a grappling device when necessary for recovering the coupler, and whatever may be attached to it, if the wireline has broken or the coupler or oilwell devices connected to the coupler are jammed in the well. The use of fishing tools and fishing necks is well known in the oilfield industry. Although the present invention aims to reduce the risk of a broken wireline, it would be imprudent to use a coupler that is not susceptible of being fished out of the well in case the wireline does break or the entire assembly becomes jammed in the well and so requires a fishing operation.

The lower portion of the coupler, sub 8, bears external screw threads 4 to enable its attachment either directly to a perforating gun (not shown), or indirectly to a perforating gun through one or more standard oilwell devices (not shown) such as a collar locator which would be connected to a perforating gun.

The middle section of the coupler has greater diameter than any other part of the coupler. That middle section is referred to as the bypass belt 5, alluding to both its function and its shape. In the preferred embodiment, the outer diameter of the bypass belt 5 is nearly the same diameter as the inner diameter of the casing 1 so that the coupler will be held approximately centrally in the casing 1 but will slide freely within the casing 1, allowing easy raising and lowering of the coupler without binding against the casing 1. For example, in a 4-inches inside diameter casing the bypass belt 5 might be 3¾ inches in diameter, while the widest part of the main body 19 of the coupler might be 3 inches in diameter.

The bypass belt 5 has longitudinal channels 6 on its outer surface, defined by fluted ridges 7. The size and number of channels 6 depend on the size of the casing 1, but one example of an embodiment has 16 channels, each ½ inch deep and ½ inch wide, on a bypass belt 5 suitable for use in a casing 1 that has an inside diameter of 4 inches.

The purpose of the channels is to allow pressurized fluid to escape, and since the pressurized fluid bypassing the coupler will first bypass the perforating gun, it is desirable that the sum of the cross-sectional areas of all channels 6 exceeds the open area surrounding the perforating gun. Otherwise, the coupler is more of an obstacle to dissipating pressure than is the perforating gun. A 3⅜ inches perforating gun in a 4-inches inside diameter casing leaves an open area of pi times (the square of one-half of 4 minus the square of one-half of 3⅜), which is 3.6 square inches. A set of 16 channels, each ½ inch on a side (neglecting curvature of the casing and curvature, if any, of the bottom of the channel, has a total area of 4 square inches. This is consistent with the coupler being less of an obstacle to dissipating pressure than is the perforating gun.

When the present invention is used along with any oilwell device such as a collar locator, it is important that the oilwell device be substantially smaller in diameter than the casing, so that pressurized fluid can bypass both the perforating gun and the oilwell device without imparting much lift to them. A reasonable arrangement is to have the diameter of the perforating gun and of any oilwell device no larger than the diameter of the main body of the coupler, that is, of the widest part of the fishing neck 3 or of the sub 8.

Figure 2:
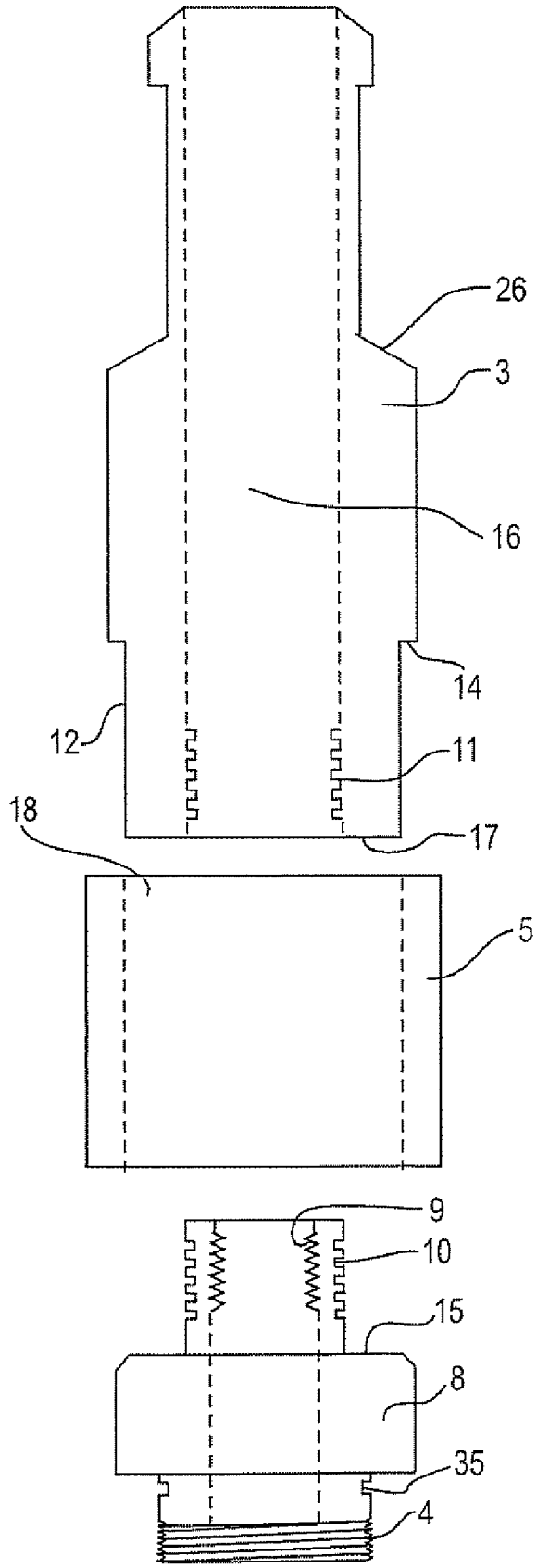
FIG. 2 is a longitudinal exploded sectional view showing details of construction of the preferred embodiment shown in FIG. 1.

FIG. 2 is an exploded sectional view of the coupler, showing details of the construction of the same embodiment depicted in FIG. 1. The wireline is not shown, but it would be attached to a rope socket (not shown) that would be attached to the sub 8 by screwing into the internal screw threads 9, and it would project some distance into the cylindrical hole 16 that passes axially through the fishing neck 3. Details of the rope socket and of how the wireline 2 is held within the rope socket are not shown, because any of various commercial rope sockets would be acceptable, and designs of rope sockets vary by manufacturer and vary according to the type of wireline to be held, but rope sockets come with screw threads that are standard in the oilfield industry. The external screw threads 10 on the sub 8 mate with the internal screw threads 11 on the fishing neck 3 and provide means for joining the sub 8 to the fishing neck 3. The sub 8 bears external screw threads 4 on its lower portion so as to couple either directly to a perforating gun (not shown), or indirectly to a perforating gun through one or more standard oilwell devices, such as a collar locator (not shown) which in turn is connected to a perforating gun.

In other words, the wireline 2 is attached to a rope socket which is screwed into the sub 8 which is screwed into the fishing neck 3 at the uphole end of the sub 8 and into a perforating gun or other oilwell device, typically a collar locator, at the downhole end of the sub 8.

The bypass belt 5 of the coupler is a separate annular piece held in place by the lower shoulder 14 of the fishing neck 3 and the upper shoulder 15 of the sub 8. When the sub 8 is unscrewed from the fishing neck 3, the bypass belt 5 can be removed for replacement. Such removability is useful both in order to discard a worn or damaged bypass belt 5, and to install a different size of bypass belt 5 to suit a particular casing 1. The bypass belt 5 can be regarded as expendable, although not necessarily so, while the fishing neck 3 and sub 8 are re-usable.

A convenient method of manufacturing the coupler is to take a standard fishing neck and turn it on a lathe to reduce its diameter in the reduced region 12 where the bypass belt 5 will be placed, that reduced region being from the downhole end 17 of the fishing neck 3 to the shoulder 14 created by the removal of material by the lathe. The shoulder 14 will confine the bypass belt 5 on its uphole side. A standard sub 8 that screws into the bottom of the fishing neck 3 will provide the other shoulder 15 needed to confine the bypass belt 5 on the downhole side. Thus confined, the bypass belt 5 will preferably have an inner cylindrical hole 18 of a diameter calculated to slide loosely over the outer diameter of the reduced region 12 of the fishing neck 3. The fit should be loose enough to allow for any differential thermal expansion of the different materials, and for small distortions due to possible damage of the bypass belt 5, but not so loose as to allow significant wobble that could lead to binding of the bypass belt 5 against the casing 1. The longer the bypass belt 5 in the axial direction, the less it can wobble. Also, the longer the bypass belt 5 in the axial direction, the closer its uphole end comes to the shoulder 26 at the lower end of the fishing neck 3, and therefore the smaller the volume of space remaining between the fishing neck 3 and the casing 1. A reduction of that space is useful, because that is the space in which wireline jamming is likely to occur. A suitable length of the bypass belt 5 for use in a 4-inches inside diameter casing is 3 inches. Rotation of the bypass belt 5 about its axis, due to looseness of fit, would not be a problem.

The sub 8 will be chosen to have internal screw threads 9 on its uphole end to which a standard rope socket (not shown) can be connected, external screw threads 10 on its uphole end to connect to the fishing neck 3, and external screw threads 4 on its downhole end to connect to the perforating gun or any oilwell device. Such subs are standard in the industry, and may include features such as a groove 35 for an o-ring that may not be used in some applications.

In the embodiment described here, the sub 8 is not in any way modified for use in the present invention, and a range of standard subs can be put in place depending on what is to be connected downhole and on the nature of a fishing neck uphole. An assortment of subs can be kept on hand for various needs that may arise. The fishing neck 3 has been modified by removing some material to allow the bypass belt 5 to fit over it, but such modification does not prevent the use of the fishing neck 3 without the bypass belt 5 in any manner in which a fishing neck could normally be used.

The above-described embodiment in three pieces is preferred because it is easy to manufacture, versatile, and makes use of standard components. However, there is no reason why the coupler could not be made as a single piece. That is, the bypass belt 5 could be an integral part of the fishing neck 3. Such a one-piece coupler could either have screw threads to receive a rope socket, or contain an integral rope socket with means for holding the wireline that are well known in existing rope sockets of various types. The lower end of such a one-piece coupler would have screw threads which might fit directly to the perforating gun or other oilwell device such as a collar locator, or such screw threads could connect to a sub if an adaptation between incompatible screw threads is ever necessary. The essence of the present invention is expressed when the coupler has any means (typically a rope socket) for being connected to a wireline, and any means (typically screw threads) for connecting to an oilwell device such as a perforating gun, and channels to allow gases and fluids under pressure to bypass the coupler.

Figure 3:
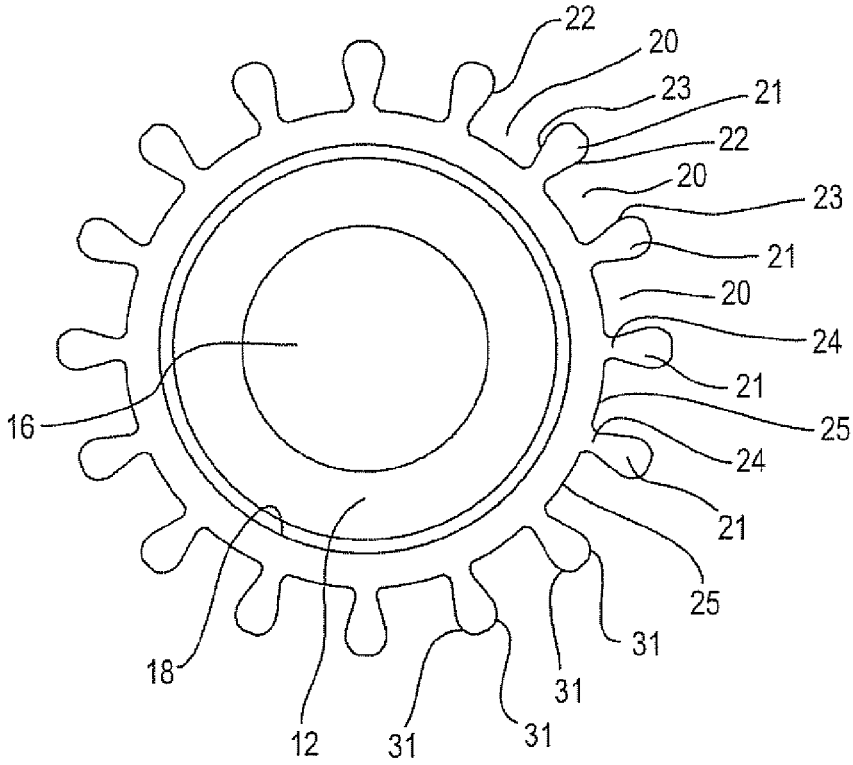
FIG. 3 is a cross sectional view along the line 3-3 of FIG. 1.

FIG. 3 shows a cross-section through the coupler at the bypass belt 5, which covers the reduced region 12 of the coupler. The inner hole 16 extends through the entire coupler from the fishing neck to the downhole end. The bypass belt 5 has longitudinal channels 20 along its entire depth, defined by longitudinal flutes 21, so that gases or fluids can flow through the channels 20 and thereby allow dissipation uphole of the pressure of such gases or fluids that would have existed downhole from the bypass belt 5. The present invention will best achieve its objective of dissipating pressure when the channels 20 have the greatest flow-through cross-sectional area. That area tends to be maximized when the two sides 22 and 23 of each channel 20 are parallel, rather than radial. Conveniently, such channels 20 can be milled with a common straight-sided milling cutter and therefore are easier to fabricate than channels with sides that are either radial or sloping. The choice of the size of the channels 20 must be balanced against the need to retain reasonable strength of the flutes 21 that form the sides of the channels. The base 24 of each straight-sided flute 21 will be narrower than the outer edge 25 of the flute 21, so the base 24 will be the weakest area of the flute 21. The flute 21 must be sufficiently strong to withstand pressures from downhole, such as from the gases released by explosives, and also withstand rough contact with the sides of the casing and possibly minor defects of the casing and rough handling on the surface when being prepared for use. The bottom 25 of each channel 20 would be flat as a result of normal simple manufacturing techniques with a milling machine, but it could be milled to match the circumference of the main body of the coupler. Such matching of contours is not essential, but would give a small benefit since discontinuities of contours cause turbulence in gas or liquid flowing past the coupler, and it is well known in the art of fluid dynamics that turbulence impedes flow and therefore turbulence would delay the dissipation of pressure. The smaller the casing 1, the more important it is that dissipation not be impeded, and hence contour matching would have some small benefit for small diameter casings and would not likely be worth the additional manufacturing cost for large diameter casings.

The flutes in the preferred embodiment have all edges chamfered, as shown at 30 in FIG. 1 and at 31 in FIG. 3, to reduce turbulence and thereby improve the flow of gases and liquids. Chamfering also reduces the risk of snagging on a rough surface, such as a defective joint, that may be present in the casing. The chamfering on the uphole and downhole ends, as shown at 30 in FIG. 1, can advantageously be quite pronounced, even to the extent of forming a shoulder that slopes from the diameter of the bypass belt 5 to the diameter of the main body 19 of the coupler. The advantage of a pronounced chamfer is that it reduces the risk of snagging or damaging the wireline if it comes into contact with the end of the bypass belt 5.

In the preferred embodiment as shown in FIG. 2 in which the bypass belt 5 is separable from the fishing neck 3 that is the main body of the coupler, the bypass belt 5 may be considered expendable after each perforating event. With that view, it could be made of a material that is most convenient and economical for fabrication, such as aluminum. The bypass belt faces the greatest risk of damage during the explosive event in the well hole, regardless of the material of which it is made, and so it is logical to regard it as an expendable item. On occasions when the bypass belt happens to suffer no damage, it could be reused.

Another advantage of the separable bypass belt 5 is that a range of sizes for it can be used on the same main body of the coupler, in order to use the same fishing neck 3 and sub 8 in well holes of different sizes. In case of a well hole whose casing 1 deviates from nominal inside diameter because of some defect in installation or some damage to it during construction or completion of the well, a slightly undersized bypass belt 5 could be used.

Figure 4:
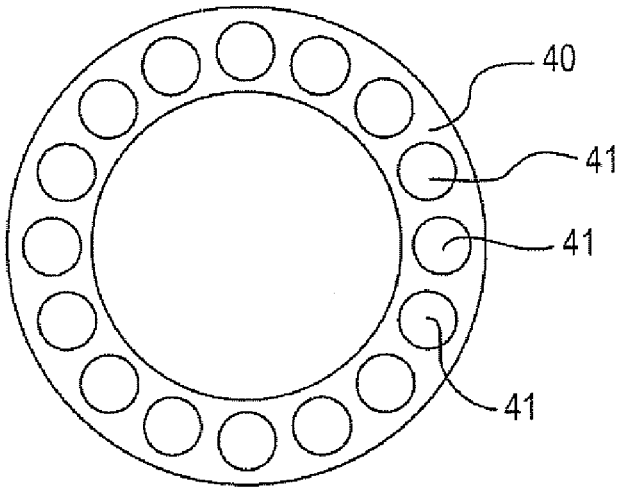
FIG. 4 is a cross sectional view that shows an alternative to FIG. 3.1.

FIG. 4 shows a cross-section through an alternative bypass belt 40, disclosing an alternative approach to creating channels to dissipate pressure. In this embodiment, the channels are circular holes 41 passing through the bypass belt 40 of the coupler. This embodiment is easy to manufacture, as holes can be produced more easily than fluted channels, but in a bypass belt of given diameter determined by the casing inside diameter, holes of practicable diameter cannot achieve as much flow-through area as fluted channels of the largest practicable diameter. The embodiment using holes would perform satisfactorily when the casing has a large inside diameter, the main body of the coupler has substantially less diameter than the casing, and the pressure to be dissipated is not large (that is, if the pressure has not scaled up in proportion to the increased size of the casing). As with the embodiment using exterior channels, a bypass belt 40 using holes 41 need not be a separable element of the coupler, and could be integral with the main body including the fishing neck.

Other designs of channels are possible. For example, the flutes could be slanted or curved spirals on the outside circumference of the bypass belt. However, such flutes would act like turbine blades and cause the coupler to rotate in response to gas or fluid pressure. Although means could be devised so that rotation would be tolerable or resisted, there is no known benefit from rotation, and there is a risk that rotation will kink or otherwise damage the wireline, damage suspended oilwell devices such as a collar locator, or even damage the casing. Therefore, slanted or curved fluting is not desirable in ordinary circumstances.

Many modifications and variations besides those mentioned herein may be made in the techniques and structures described and depicted herein, resulting in other embodiments of the present invention without departing from the concept of the present invention. The foregoing disclosures should not be construed in any limited sense other than the limits of the claims that follow.

What is claimed is:

1. A coupler for connecting a wireline to a perforating gun used in oil wells and natural gas wells that contain a casing of the well hole, comprising (a) a first hollow cylindrical body shaped as a fishing neck at the uphole end and having connection means at the downhole end for connecting to a sub, and having a first external shoulder marking a transition in the downhole direction from a larger external diameter to a smaller external diameter;

(b) a bypass belt that is a second hollow cylindrical body mounted coaxially over said smaller external diameter of said first hollow cylindrical body, containing channels through which gas and liquid may flow from the downhole side of the coupler to the uphole side of the coupler, having an outer diameter that is larger than said larger external diameter of said first hollow cylindrical body;

(c) a sub that is a third cylindrical body having (i) means for connecting to said first hollow cylindrical body, (ii) means for connecting to a wireline in the uphole direction, (iii) means for connecting to a perforating gun in the downhole direction, and (iv) a second external shoulder in the uphole direction that holds said bypass belt between said second external shoulder and said first external shoulder on said first hollow cylindrical body.

2. The coupler of claim 1, in which said channels are longitudinal grooves on the outer circumference of said bypass belt running from the downhole side of the coupler to the uphole side of the coupler.

3. The coupler of claim 1, in which said channels are holes passing through said bypass belt from its downhole side to its uphole side.

4. The coupler of claim 1, in which said means for connecting to a perforating gun comprise an internal threaded connection.

5. The coupler of claim 1, in which said means for connecting to a perforating gun comprise an internal threaded connection to which is connected any oilwell device interposed between said internal threaded connection and said perforating gun.

6. The coupler of claim 1, in which said bypass belt may have any one of a number of outside diameters in order to fit a particular size of casing, while having one size of inside diameter to fit said first hollow cylindrical body, such that said bypass belts can be replaced when worn or damaged.

7. The coupler of claim 1, in which the difference between said outer diameter of said bypass belt and the inside diameter of the casing of the well hole is less than the diameter of said wireline.

* * * * *